US009448506B1

(12) United States Patent
Awano

(10) Patent No.: US 9,448,506 B1
(45) Date of Patent: Sep. 20, 2016

(54) DEVELOPER DISCHARGE STRUCTURE AND IMAGE FORMING APPARATUS

(71) Applicant: FUJI XEROX Co., Ltd., Minato-ku, Tokyo (JP)

(72) Inventor: Toyohiko Awano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/875,189

(22) Filed: Oct. 5, 2015

(30) Foreign Application Priority Data

Mar. 27, 2015 (JP) ..... 2015-066293

(51) Int. Cl.
*G03G 15/08* (2006.01)

(52) U.S. Cl.
CPC ..... *G03G 15/0865* (2013.01)

(58) Field of Classification Search
CPC .... G03G 15/10; G03G 15/12; G03G 15/105; G03G 15/0865
See application file for complete search history.

(56) References Cited

U.S. PATENT DOCUMENTS 5,235,391 A * 8/1993 Aimoto ..... G03G 15/0844 399/257
8,526,847 B2 9/2013 Kataoka
2004/0052559 A1* 3/2004 Jeong ..... G03G 21/105 399/358
2008/0056772 A1* 3/2008 Utsumi ..... G03G 15/0872 399/254
2008/0124119 A1* 5/2008 Oda ..... G03G 15/0898 399/120
2009/0103951 A1* 4/2009 Tsuda ..... G03G 15/0877 399/254
2009/0123178 A1* 5/2009 Suzuki ..... G03G 21/168 399/121
2010/0021204 A1* 1/2010 Nakazawa ..... G03G 21/10 399/120
2010/0172673 A1* 7/2010 Akaike ..... G03G 21/12 399/258
2010/0247137 A1* 9/2010 Akaike ..... G03G 21/12 399/110
2010/0322666 A1* 12/2010 Inomata ..... G03G 15/0896 399/120
2011/0085835 A1* 4/2011 Sato ..... G03G 21/12 399/360
2011/0103856 A1* 5/2011 Sato ..... G03G 21/12 399/360
2011/0158723 A1* 6/2011 Yokokawa ..... G03G 21/105 399/358
2011/0318026 A1* 12/2011 Kurimoto ..... G03G 21/12 399/35
2012/0002983 A1* 1/2012 Kataoka ..... G03G 15/0863 399/12
2013/0195510 A1* 8/2013 Eto ..... G03G 15/0896 399/258
2013/0259532 A1* 10/2013 Kubota ..... G03G 21/1676 399/254
2014/0112688 A1* 4/2014 Suenaga ..... G03G 21/105 399/257
2014/0140725 A1* 5/2014 Kawasumi ..... G03G 15/0879 399/119
2015/0177648 A1* 6/2015 Morishita ..... G03G 21/105 399/358

FOREIGN PATENT DOCUMENTS

JP 2006-106056 A 4/2006
JP 2011-008214 A 1/2011
JP 2012-014008 A 1/2012

* cited by examiner

*Primary Examiner* — David Bolduc
(74) *Attorney, Agent, or Firm* — Sughrue Mion, PLLC

(57) ABSTRACT

A developer discharge structure includes a tube-shaped container portion disposed in an apparatus body and holding developer, the container portion having an outlet port that allows the developer to be discharged to a recovery container; an opening-closing member disposed in the container portion, opening the outlet port when the recovery container is positioned in an attached position in which the recovery container is attached to the apparatus body, and closing the outlet port when the recovery container is positioned in a detached position in which the recovery container is detached from the apparatus body; and an operating member disposed in the apparatus body and performing a detachment preparation operation, in which a member disposed adjacent to the container portion is prepared for detachment from the apparatus body, to restrict movement of the opening-closing member from a position in which the opening-closing member closes the outlet port.

5 Claims, 15 Drawing Sheets

DEVELOPER DISCHARGE STRUCTURE AND IMAGE FORMING APPARATUS

CROSS-REFERENCE TO RELATED APPLICATIONS

This application is based on and claims priority under 35 USC 119 from Japanese Patent Application No. 2015-066293 filed Mar. 27, 2015.

BACKGROUND

Technical Field

The present invention relates to a developer discharge structure and an image forming apparatus.

SUMMARY

A developer discharge structure according to an aspect includes a tube-shaped container portion disposed in an apparatus body and holding developer, the container portion having an outlet port at a first axial end portion of the container portion, the outlet port allowing the developer to be discharged therethrough to a recovery container; an opening-closing member disposed in the container portion, the opening-closing member opening the outlet port when the recovery container is positioned in an attached position in which the recovery container is attached to the apparatus body, the opening-closing member closing the outlet port when the recovery container is positioned in a detached position in which the recovery container is detached from the apparatus body; and an operating member disposed in the apparatus body, the operating member performing an operation for a detachment preparation, in which an adjacent member disposed adjacent to the container portion is prepared for detachment from the apparatus body, to restrict movement of the opening-closing member from a position in which the opening-closing member closes the outlet port.

BRIEF DESCRIPTION OF THE DRAWINGS

Exemplary embodiments of the present invention will be described in detail based on the following figures, wherein.

DETAILED DESCRIPTION

Figure 1:
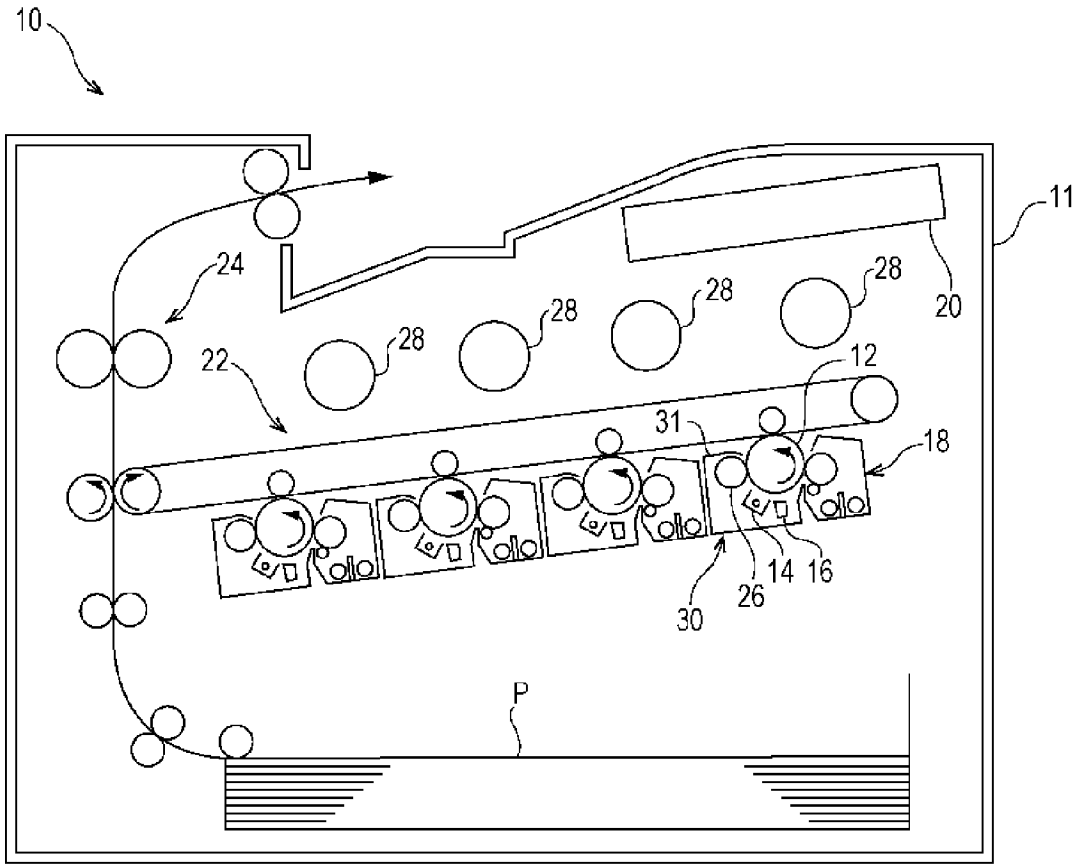
FIG. 1 is a schematic configuration diagram of an image forming apparatus according to an exemplary embodiment of the invention.
Figure 1:
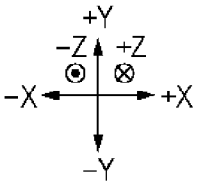

Referring now to the drawings, a developer discharge structure according to an exemplary embodiment of the invention and an image forming apparatus including the developer discharge structure are described.

Entire Configuration

Firstly, an image forming apparatus 10 according to an exemplary embodiment is described.

As illustrated in FIG. 1, the image forming apparatus 10 includes a housing 11 serving as an apparatus body. The image forming apparatus 10 also includes, inside the housing 11, photoconductors 12, which are examples of an image carrying member, charging devices 14, exposure devices 16, developing devices 18, a controller 20, a transfer device 22, a fixing device 24, cleaning devices 26, toner cartridges 28, and a developer discharge structure 40. One of the photoconductors 12, one of the charging devices 14, one of the exposure devices 16, and one of the cleaning devices 26 constitute a photoconductor unit 30. A housing 31 of each photoconductor unit 30 is removably attached to the housing 11.

In the following description, assuming that a user (not illustrated) sees the image forming apparatus 10 from the front from the side on which the user is located, the apparatus width direction, the apparatus height direction, and the apparatus depth direction are respectively expressed as the X direction, the Y direction, and the Z direction. The X direction, the Y direction, and the Z direction are perpendicular to one another. When negative and positive directions of each of the X direction, the Y direction, and the Z direction need to be distinguished from each other, the upward direction is denoted by a +Y direction, the downward direction is denoted by a −Y direction, the rightward direction is denoted by a +X direction, the leftward direction is denoted by a −X direction, the backward direction is denoted by a +Z direction, and the frontward direction is denoted by a −Z direction when the image forming apparatus 10 is viewed from the front. The Y direction is an example of a direction of gravity. The X direction and the Z direction are examples of the horizontal direction.

Figure 2:
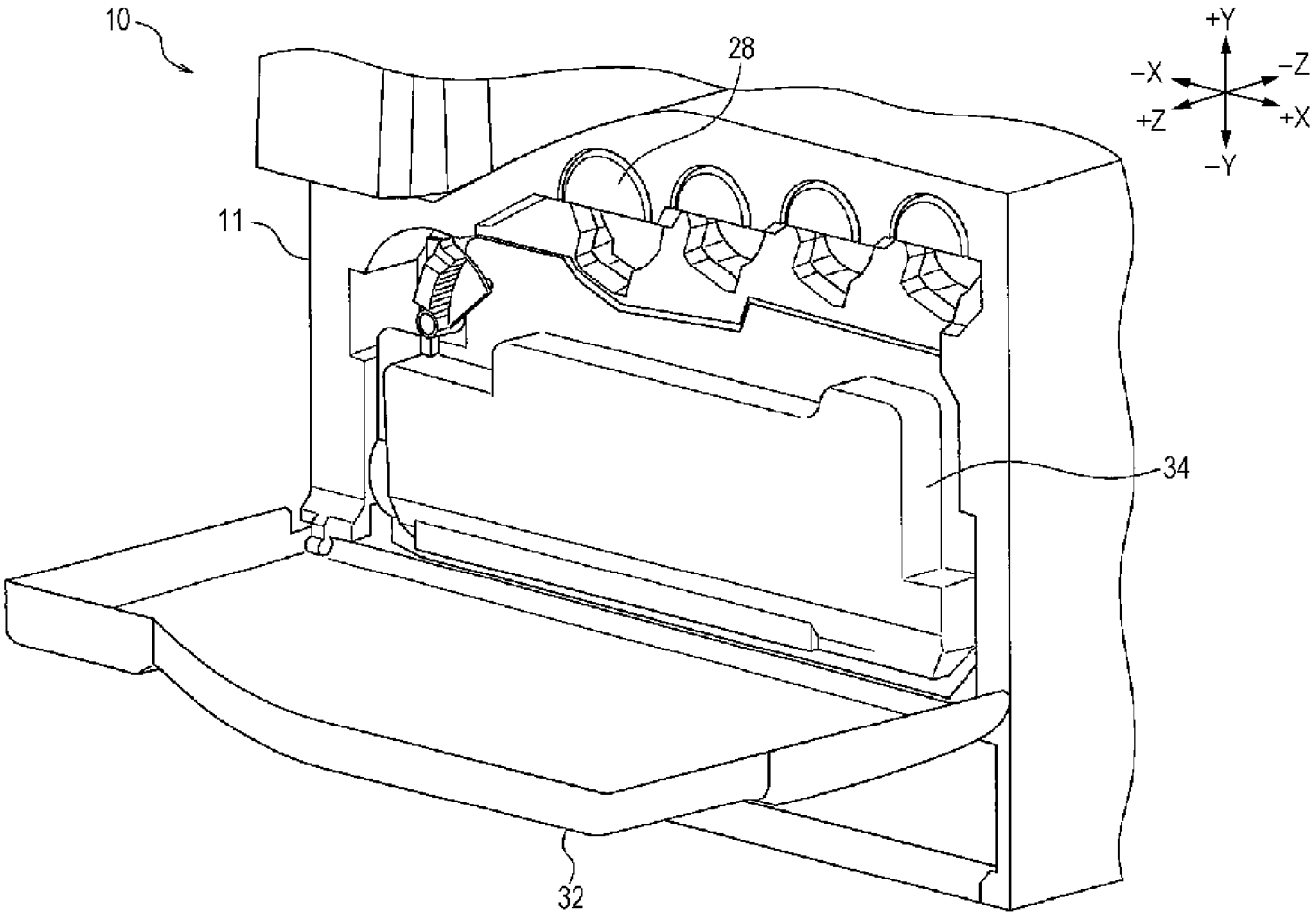
FIG. 2 is a perspective view of an image forming apparatus according to an exemplary embodiment of the invention and illustrates a covering in the state of being uncovered.
Figure 3:
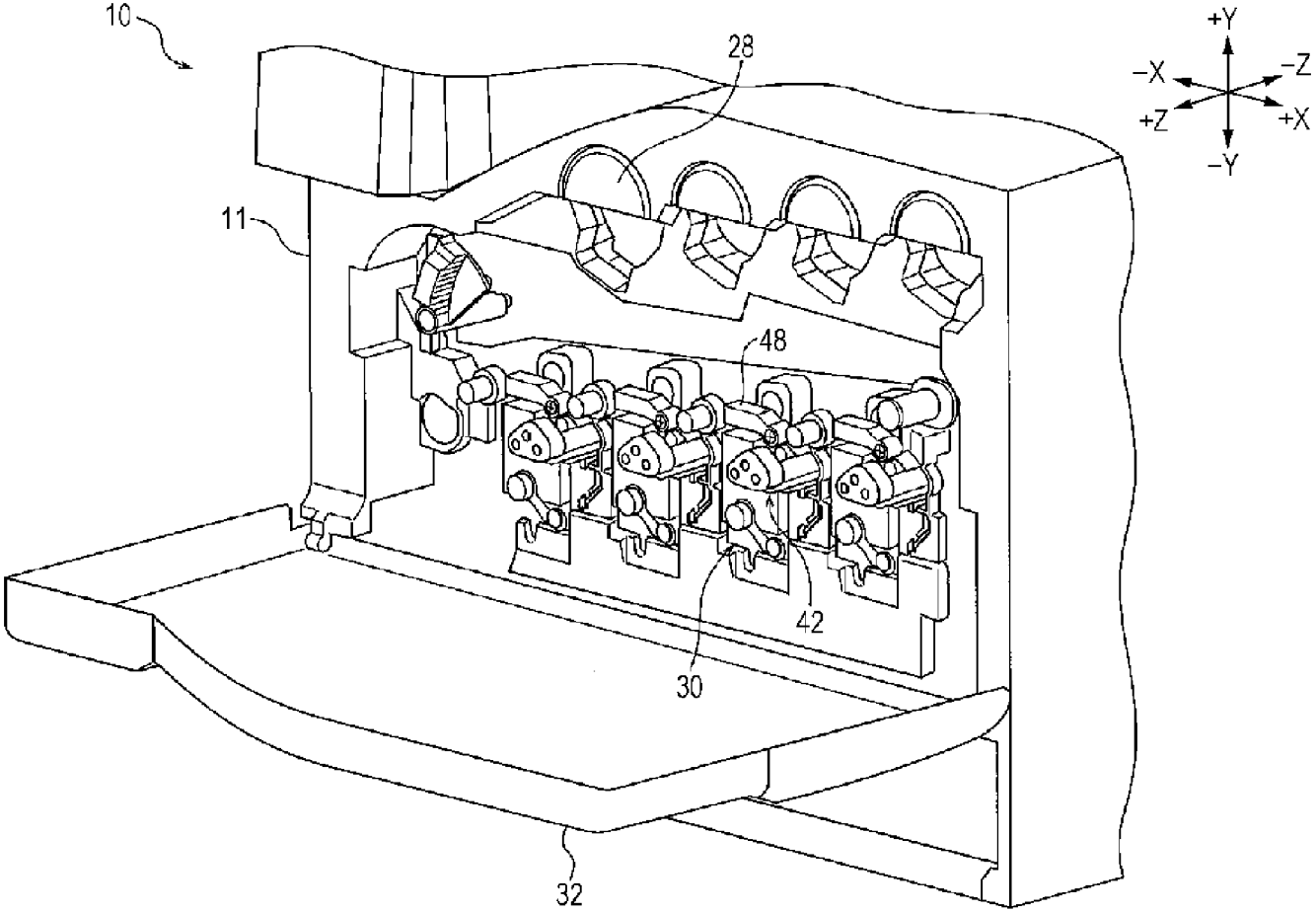
FIG. 3 is a perspective view of an image forming apparatus according to an exemplary embodiment of the invention and illustrates a recovery container in the state of being detached from the image forming apparatus.

As illustrated in FIG. 2, a covering 32 that rotates frontward in the apparatus depth direction is attached to the front surface of the housing 11. To the back of the covering 32 in the apparatus depth direction, a recovery container 34 is removably attached to the housing 11. When the recovery container 34 is detached from the housing 11, in other words, when the recovery container 34 is moved to a detached position with respect to the housing 11, the photoconductor units 30 corresponding to the respective colors and attached to the housing 11 are exposed to the outside (see FIG. 3).

When a control lever 48, described below, is rotated from a first rotation position (for example, the position illustrated in FIG. 4 and FIG. 9) to a second rotation position (for example, the position illustrated in FIG. 10 and FIG. 11) while the recovery container 34 is in a detached state, each developing device 18 is retracted with respect to the corresponding photoconductor 12 by a retracting mechanism, not illustrated. This operation of rotating the control lever 48 from the first rotation position to the second rotation position moves each developing device 18 with respect to the corresponding photoconductor 12. Thus, this operation of moving the control lever 48 to this detachment position is referred to as an operation on the control lever 48 for the detachment preparation. When the operation on the control lever 48 for the detachment preparation is performed and then a fastening device 35 for fastening the housing 31 to the housing 11 is removed, the photoconductor unit 30 is allowed to be pulled out to the front in the apparatus depth direction, whereby the photoconductor unit 30 becomes detachable from the housing 11.

Subsequently, the operation of the image forming apparatus 10 is described.

The operation of each component of the image forming apparatus 10 is controlled by the controller 20. In this image forming apparatus 10, the developing device 18 develops a latent image on the photoconductor 12 with developer transported from the toner cartridge 28 to form a toner image, which is an example of a developer image. Furthermore, in the image forming apparatus 10, after the transfer device 22 transfers a toner image to a sheet P, which is an example of a recording medium, the fixing device 24 fixes the toner image to the sheet P.

The developer G contains, for example, toner, an iron carrier, and an additive. The toner is an example of a negatively charged granular material. The iron carrier is an example of a positively charged magnetic substance. The toner is made of, for example, polyester resin.

Characteristic Configuration

Subsequently, the developer discharge structure 40 according to a first exemplary embodiment is described.

Figure 4:
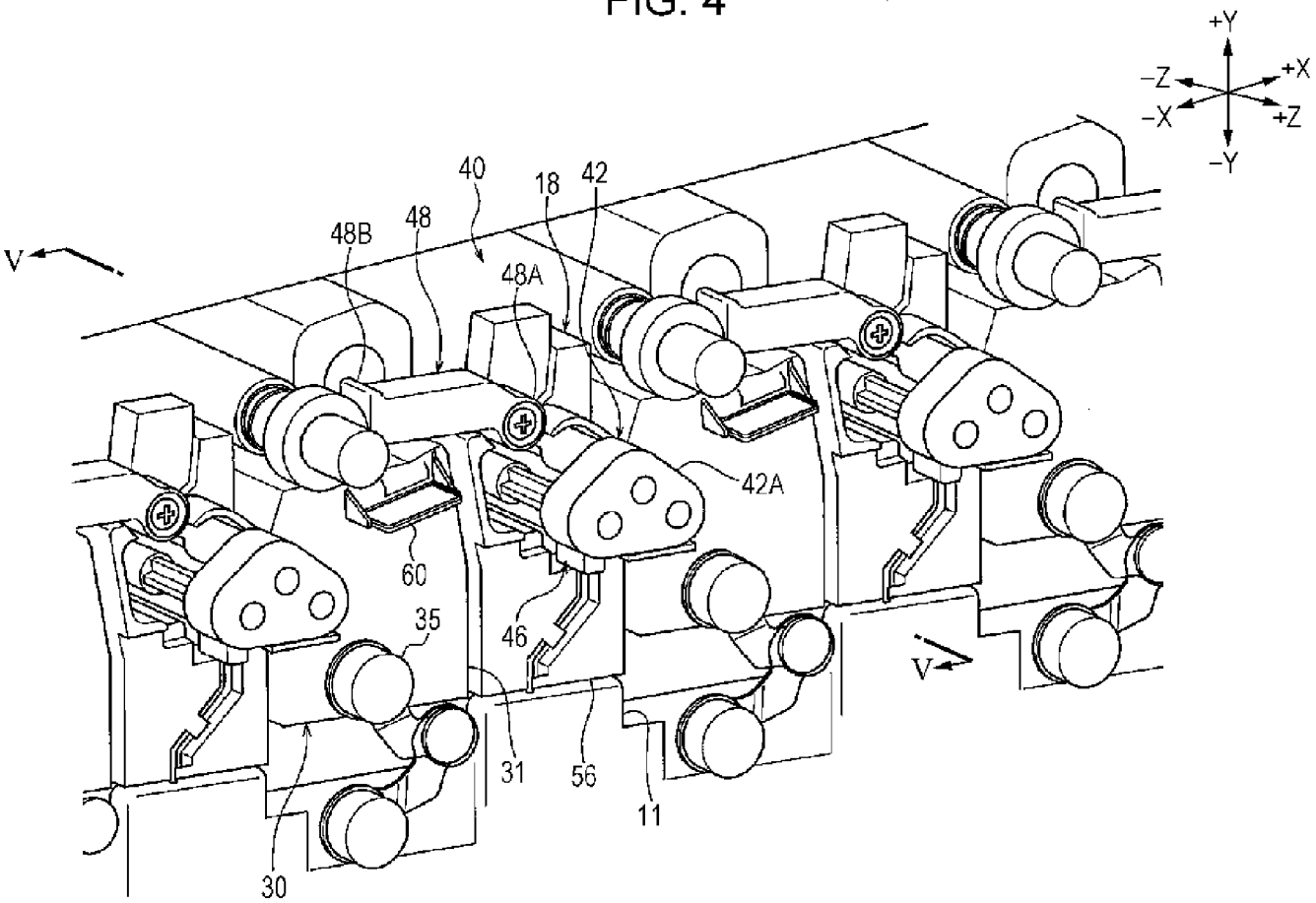
FIG. 4 is an enlarged perspective view of a characteristic portion of a developer discharge structure according to an exemplary embodiment of the invention and illustrates a recovery container in the state of being detached from the image forming apparatus.
Figure 5:
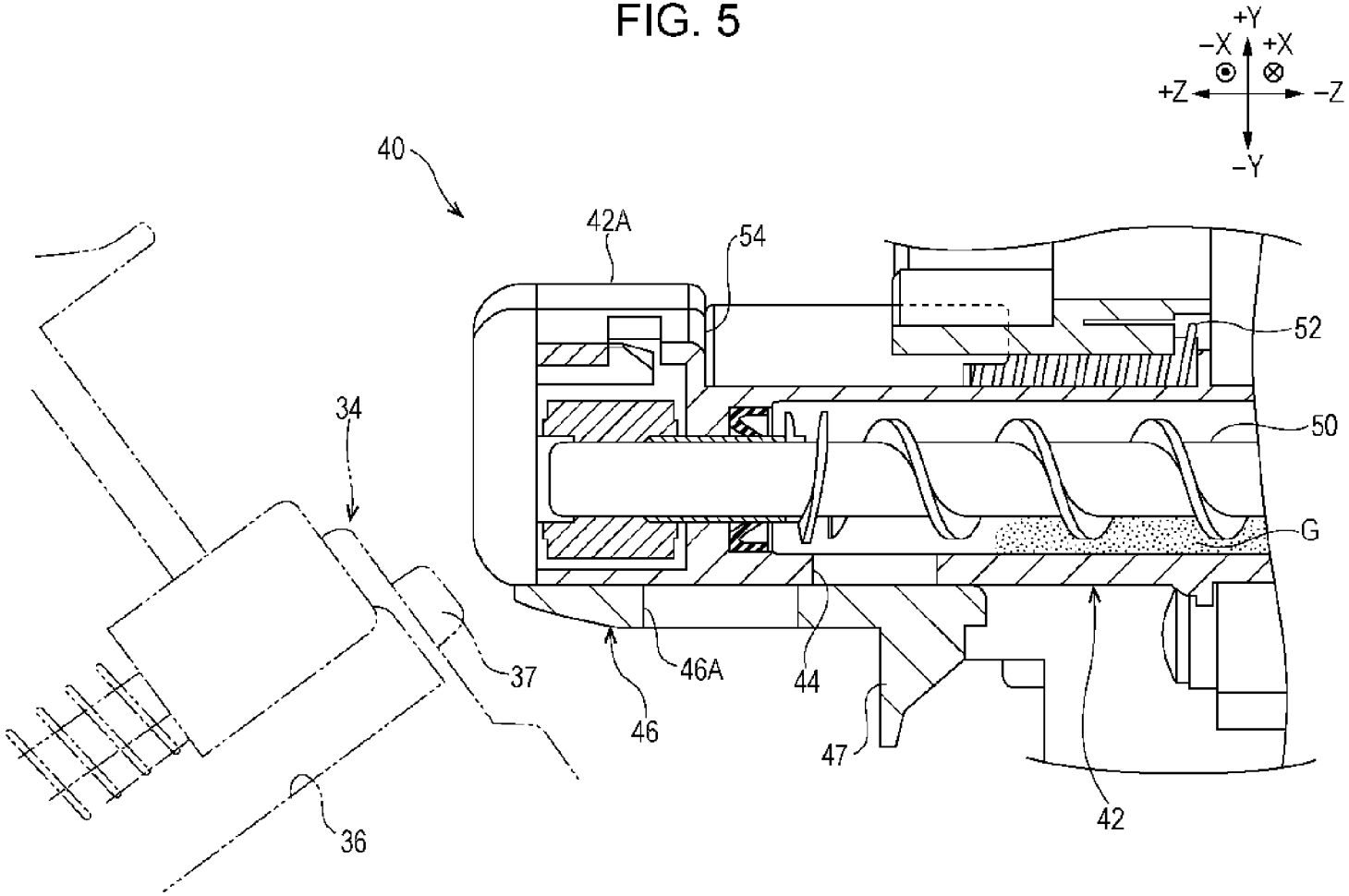
FIG. 5 is a cross-sectional view of the developer discharge structure taken along the line V-V of FIG. 4.
Figure 7:
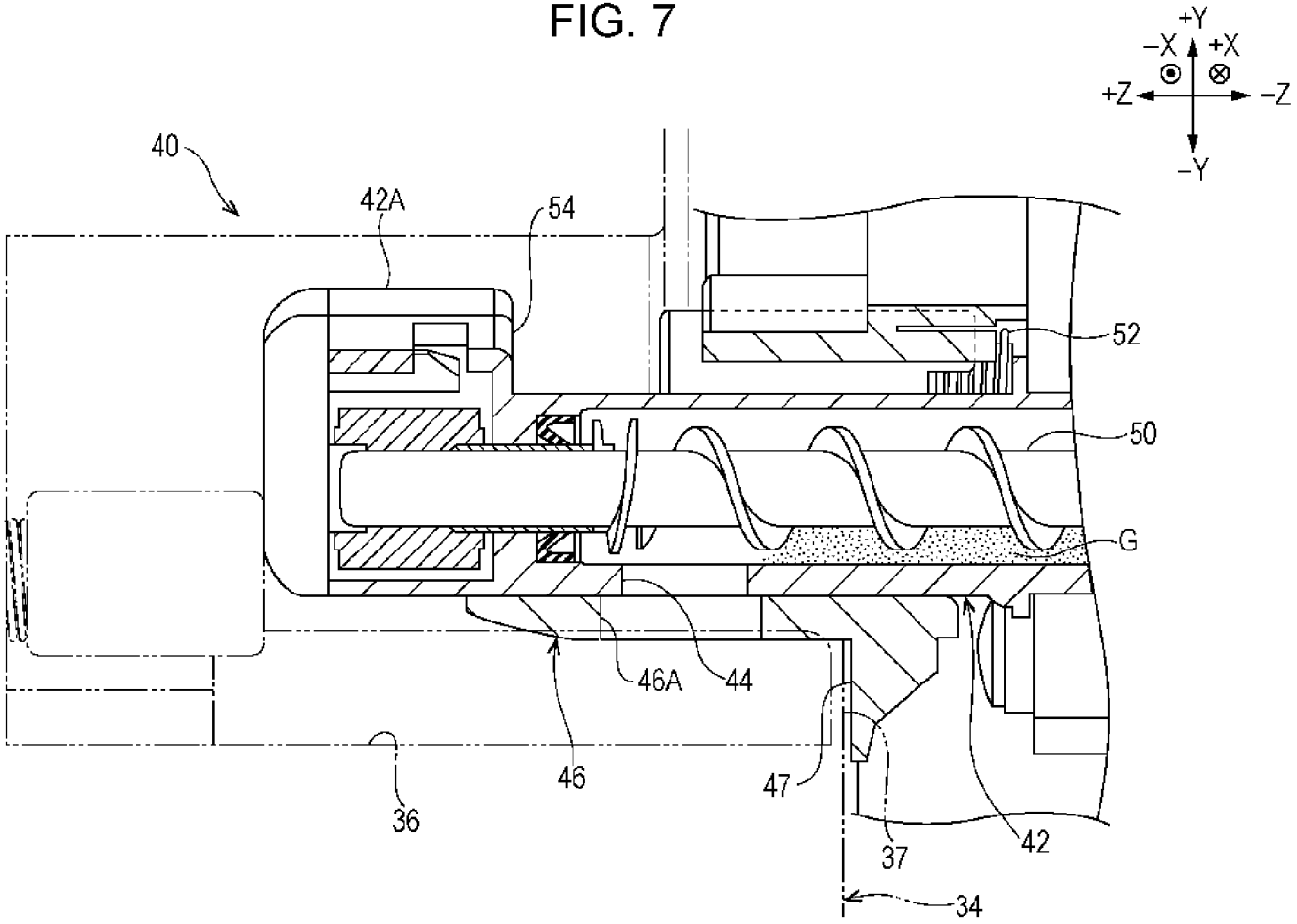
FIG. 7 is a cross-sectional view of the developer discharge structure taken along the line VII-VII of FIG. 6.

As illustrated in FIG. 5 and FIG. 7, the developer discharge structure 40 includes a discharge pipe 42, which is an example of a cylindrical container that holds the developer G, an outlet port 44, which is an example of an outlet port that allows the developer G to be discharged therethrough from the discharge pipe 42 to the recovery container 34, a shutter 46, which is an example of an opening-closing member that opens and closes the outlet port 44, and a control lever 48 (see FIG. 4), which is an example of an operating member that restricts the movement of the shutter 46 from a position in which the shutter 46 closes the outlet port 44 by performing an operation for a detachment preparation, described below.

As illustrated in FIG. 4 and FIG. 5, the discharge pipe 42 constitutes a part of the developing device 18. This discharge pipe 42 forms a discharge path for discharging, to the recovery container 34, part of the developer G that is circulated in the developing device 18 while being supplied from the toner cartridge 28. This discharge path extends in the apparatus depth direction.

An auger 50 is disposed in the discharge pipe 42. This auger 50 transports part of the developer G circulated in the developing device 18 toward the outlet port 44, described below.

Figure 12:
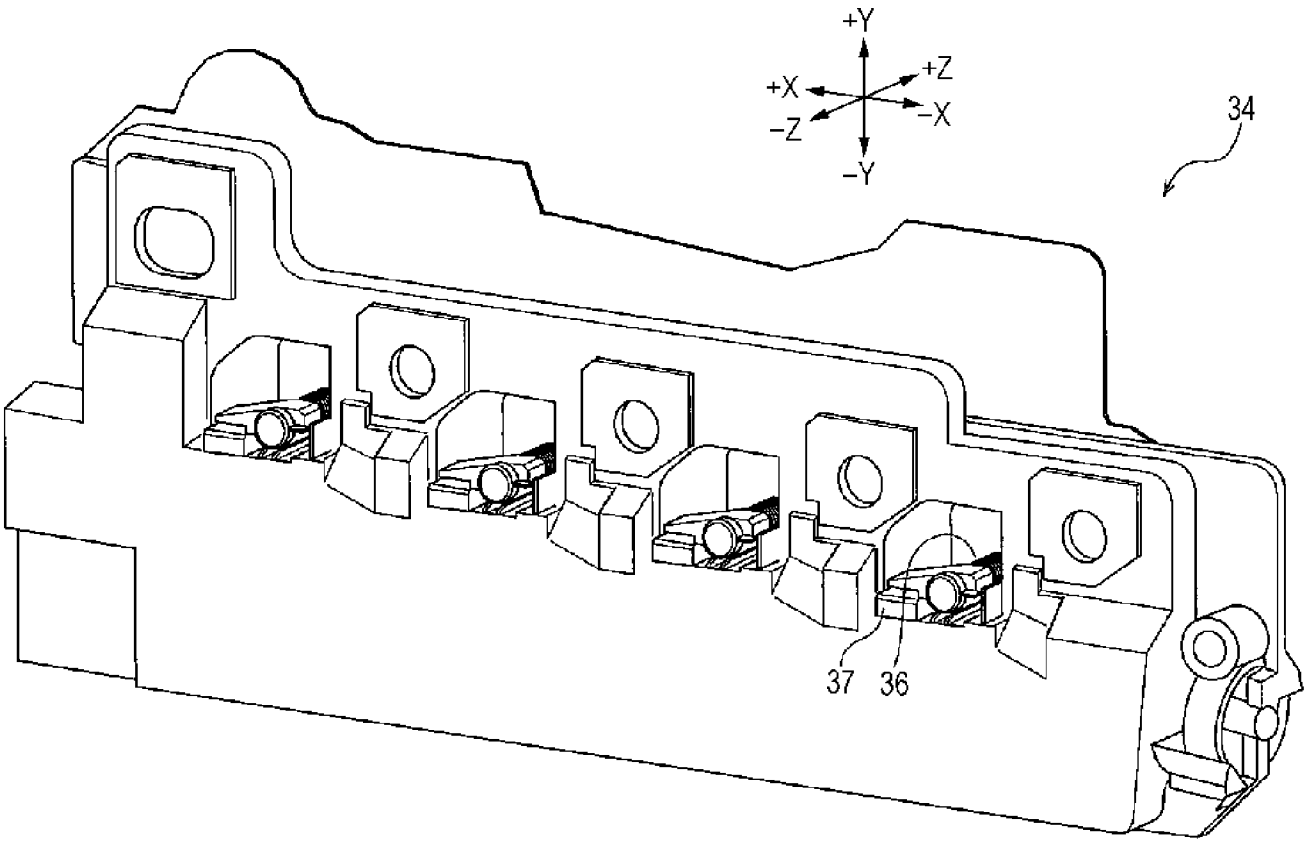
FIG. 12 is a perspective view of the recovery container in FIG. 2 viewed from the back and illustrates a recovery container in the state of being detached from the image forming apparatus.
Figure 13:
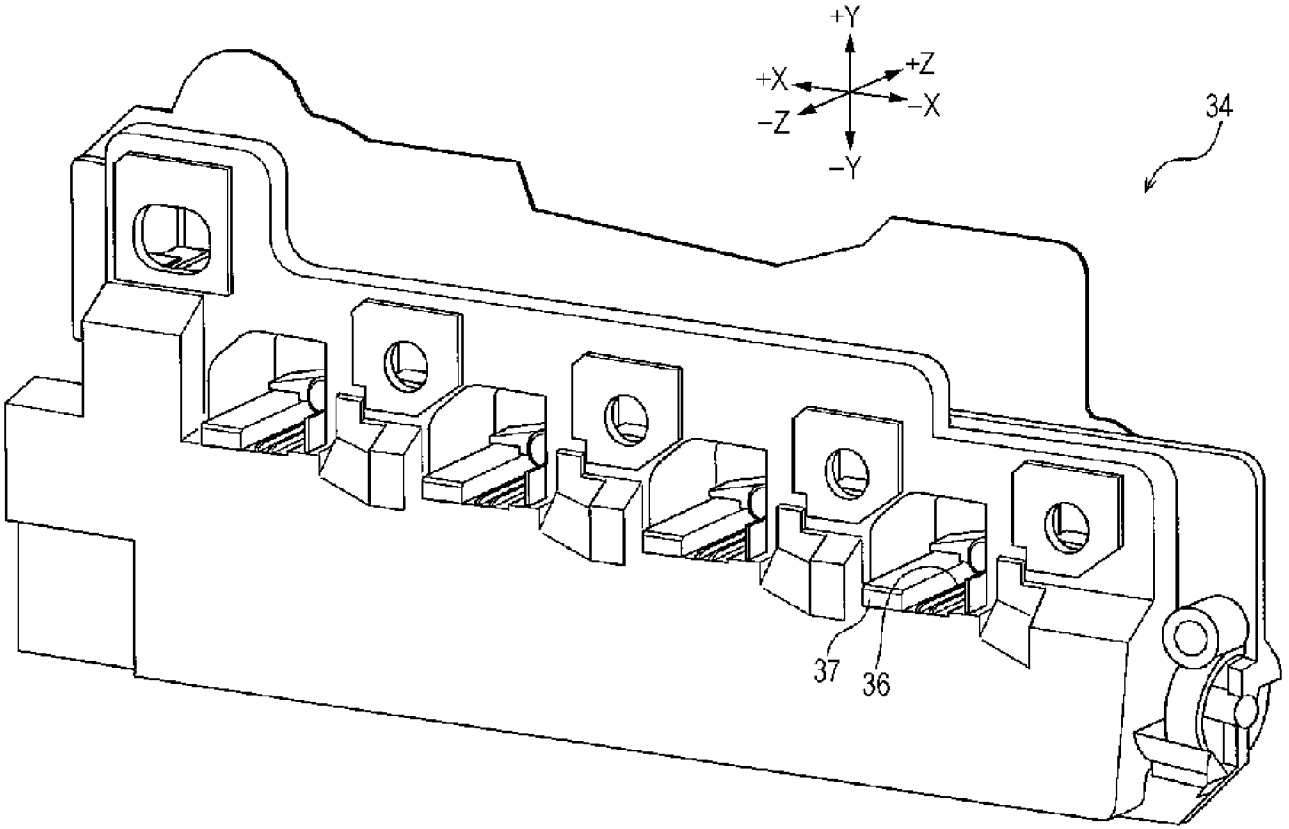
FIG. 13 is a perspective view of the recovery container in FIG. 2 viewed from the back and illustrates a recovery container in the state of being attached to the image forming apparatus.

A first axial end portion 42A (on the front side in the apparatus depth direction) of the discharge pipe 42 is inserted into a recovery port 36 (see FIG. 12 and FIG. 13) formed on the back surface of the recovery container 34 in the state where the recovery container 34 is attached to the housing 11.

The outlet port 44 is formed near the first axial end portion 42A of the discharge pipe 42 so as to open downward. In the state where the recovery container 34 is attached to the housing 11, the outlet port 44 is enclosed in the recovery port 36 formed on the back surface of the recovery container 34.

Figure 6:
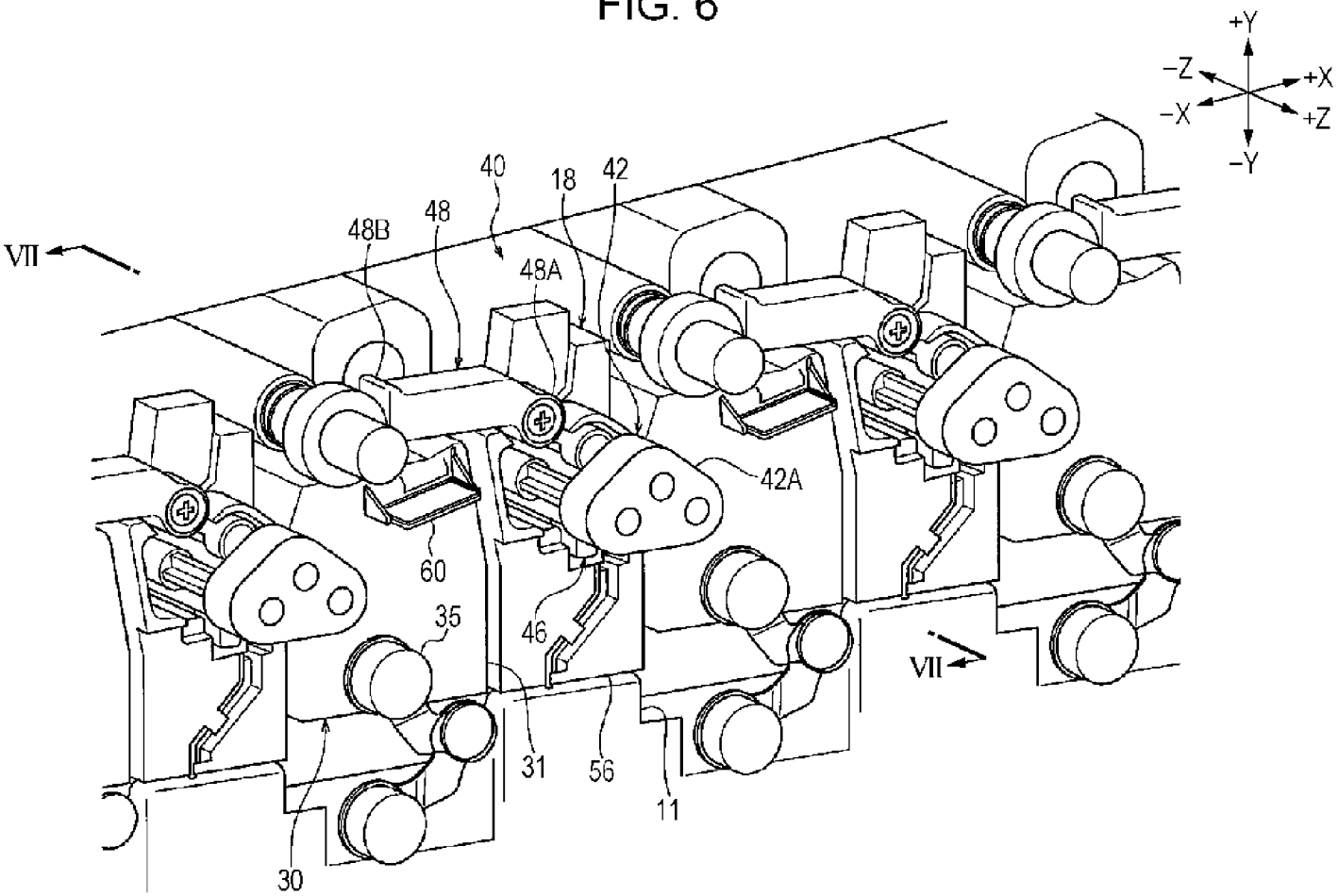
FIG. 6 is an enlarged perspective view of a characteristic portion of a developer discharge structure according to an exemplary embodiment of the invention and illustrates a recovery container in the state of being attached to the image forming apparatus.

In the state where the recovery container 34 is in an attached position (attached state) as illustrated in FIG. 6 and FIG. 7, in which the recovery container 34 is attached to the housing 11, the shutter 46 opens the outlet port 44. In the state where the recovery container 34 is in a detached position (detached state) as illustrated in FIG. 4 and FIG. 5, in which the recovery container 34 is detached from the housing 11, the shutter 46 closes the outlet port 44. Specifically, the shutter 46 covers the first axial end portion 42A of the discharge pipe 42, which is substantially tube-shaped, and is slidable over the discharge pipe 42. Here, the shutter 46 is urged to the front in the apparatus depth direction by a coil spring 52, which is an example of an urging member. When the recovery container 34 is in the detached position, the shutter 46 is kept in the state of being in contact with a stopper portion 54, formed at the first axial end portion 42A of the discharge pipe 42, by the urging force of the coil spring 52.

A through hole 46A is formed at a lower portion of the shutter 46. When this through hole 46A coincides with the outlet port 44 as a result of movement (sliding) of the shutter 46, the outlet port 44 is opened, whereby the developer G in the discharge pipe 42 is discharged through the outlet port 44 and the through hole 46A. The discharged developer G is transported from the recovery port 36 into the recovery container 34. When the recovery container 34 is in the attached position, the through hole 46A of the shutter 46 and the outlet port 44 coincide with each other, as will be described below. The position of the through hole 46A in the shutter 46 is determined so that the through hole 46A of the shutter 46 and the outlet port 44 do not coincide with each other when the recovery container 34 is in the detached position. Coinciding of the through hole 46A of the shutter 46 and the outlet port 44 with each other here includes the cases where the through hole 46A and the outlet port 44 coincide with each other entirely and partly.

A catching portion 47 protruding downward is disposed below the shutter 46. When the recovery container 34 is in the attached position, this catching portion 47 is pressed by a pressing portion 37 disposed near the recovery port 36 of the recovery container 34. When the catching portion 47 is pressed by the pressing portion 37, the shutter 46 is moved to the back in the apparatus depth direction, so that the through hole 46A and the outlet port 44 coincide with each other.

Specifically, as illustrated in FIG. 7, when the recovery container 34 is in the attached position, the pressing portion 37 of the recovery container 34 is in contact with the catching portion 47 of the shutter 46 to press the catching portion 47. This pressing of the pressing portion 37 moves the shutter 46 to the back in the apparatus depth direction, so that the through hole 46A of the shutter 46 and the outlet port 44 coincide with each other.

On the other hand, as illustrated in FIG. 5, when the recovery container 34 is in the detached position, the shutter 46 is urged to the front in the apparatus depth direction by the urging force of the coil spring 52, so that the through hole 46A and the outlet port 44 become displaced from each other. Thus, the outlet port 44 is closed by the shutter 46.

Figure 8:
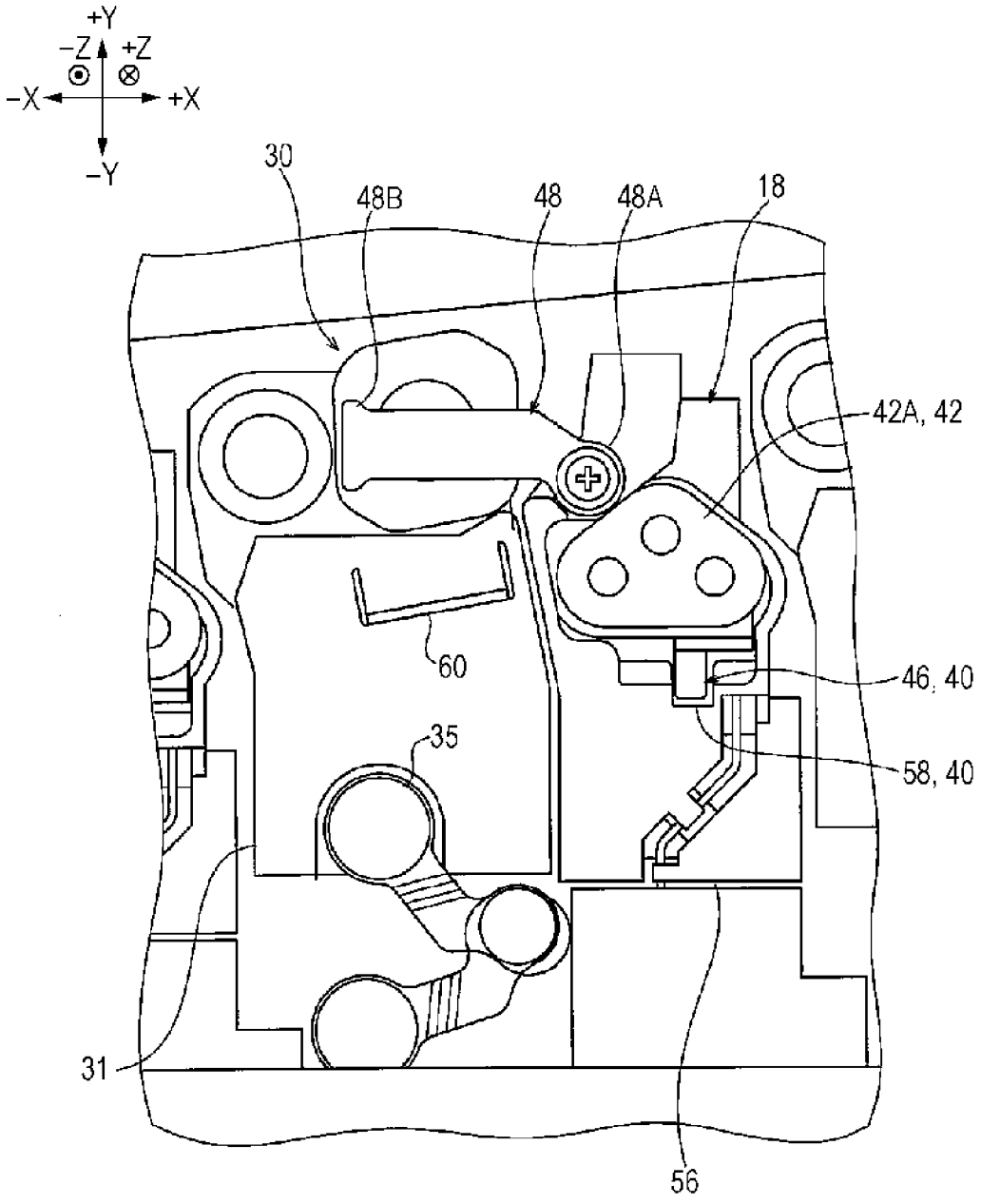
FIG. 8 is a front view of an image forming unit of an image forming apparatus according to an exemplary embodiment of the invention.
Figure 9:
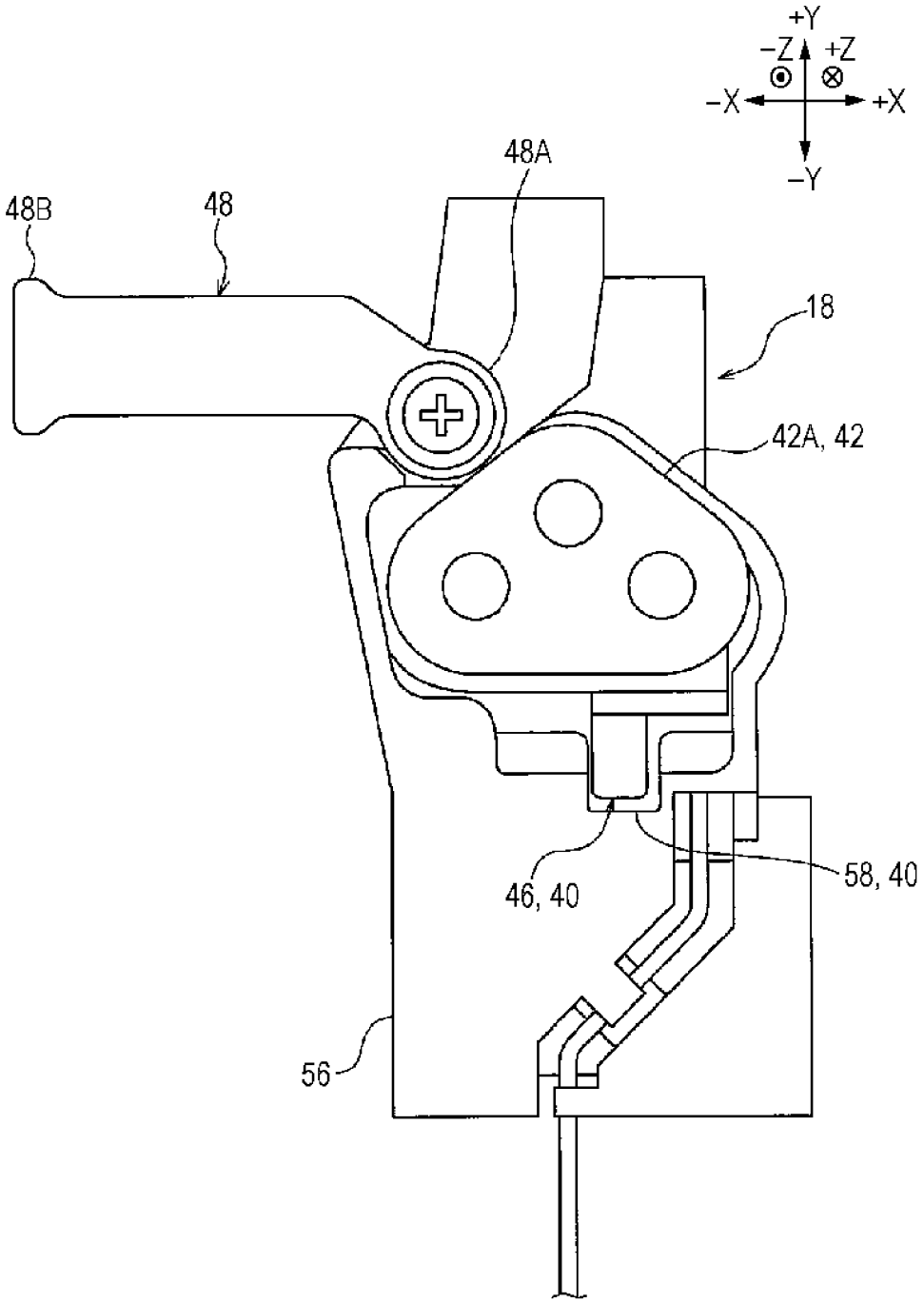
FIG. 9 is a front view of a developing device of an image forming apparatus according to an exemplary embodiment of the invention and illustrates an operating member in the state of being positioned in a first rotation position.
Figure 10:
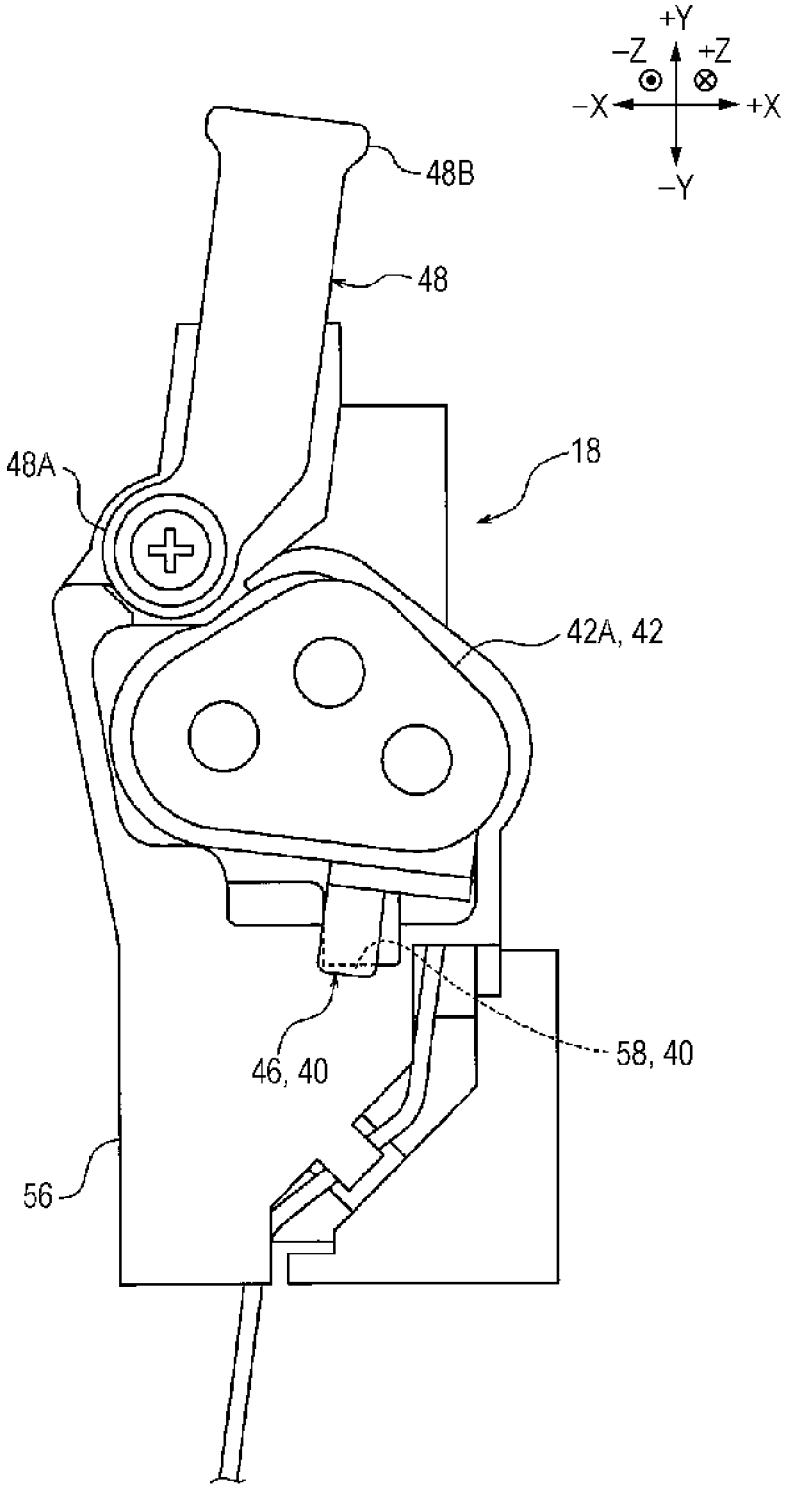
FIG. 10 is a front view of a developing device of an image forming apparatus according to an exemplary embodiment of the invention and illustrates an operating member in the state of being positioned in a second rotation position.
Figure 11:
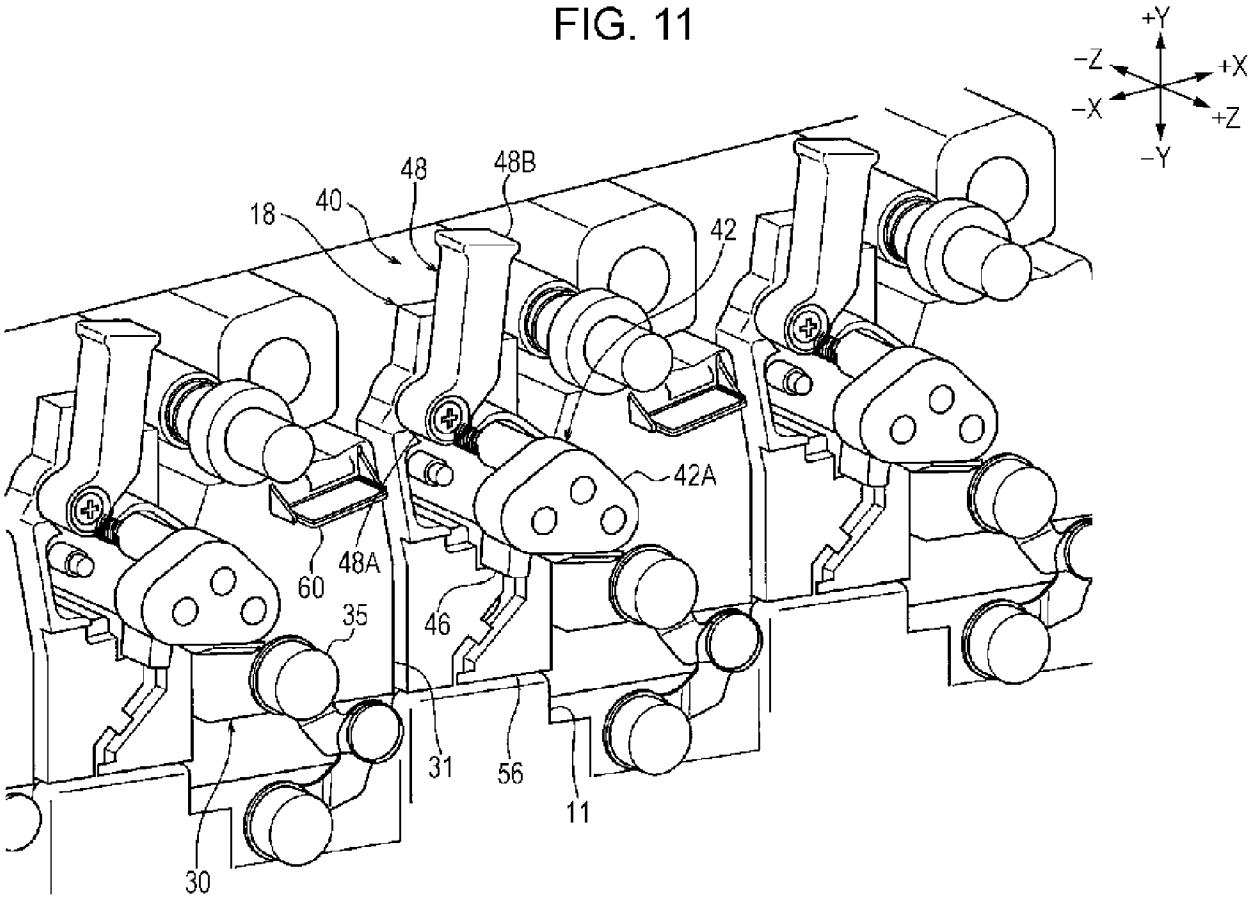
FIG. 11 corresponds to the enlarged perspective view of the characteristic portion of the developer discharge structure in FIG. 4 and illustrates the operating members in the state of being positioned in the second rotation position.

As illustrated in FIG. 8 to FIG. 10, the control lever 48 is rotatably supported by a support frame 56 that fixes the developing device 18 to the housing 11. Specifically, a first end portion 48A of the control lever 48 is supported by the support frame 56 so as to be rotatable around the rotational axis extending in the apparatus depth direction. A second end portion 48B of the control lever 48 serves as a grip portion of the control lever 48.

This control lever 48 is linked together with a retracting mechanism, not illustrated. When the control lever 48 is rotated from a first rotation position to a second rotation position, this retracting mechanism moves the developing device 18 with respect to the photoconductor 12 so that the developing device 18 is moved further away from the photoconductor 12. On the other hand, when the control lever 48 is rotated from the second rotation position to the first rotation position, the retracting mechanism moves the developing device 18 toward the photoconductor 12 so as to cause the developing device 18 to track the photoconductor 12. Here, the wording "the developing device 18 tracks the photoconductor 12" here means that a developing roller, constituting the developing device 18 and not illustrated, is caused to face the photoconductor 12 at a predetermined distance.

As illustrated in FIG. 9 and FIG. 10, when the control lever 48 is rotated from the first rotation position to the second rotation position (operated for a detachment preparation), the developing device 18 is tilted with respect to the support frame 56. Specifically, an eccentric cam is disposed on the rotation shaft, which is not illustrated and supports the first end portion 48A of the control lever 48 so that the first end portion 48A is rotatable. This eccentric cam moves the developing device 18 away from the photoconductor 12 while tilting the developing device 18 with respect to the support frame 56 when the control lever 48 is operated for the detachment preparation, so that the developing device 18 is retracted with respect to the photoconductor 12. Here, when the control lever 48 is operated for the detachment preparation, the discharge pipe 42 contained in the developing device 18 is also tilted with respect to the support frame 56, whereby a part of the support frame 56 is located on the movement path of the shutter 46. In the following description, a part of the support frame 56 located on the movement path of the shutter 46 in the state where the control lever 48 has been operated for the detachment preparation is referred to as a stopper portion 58. The stopper portion 58 may protrude from or may be recessed into the front surface of the support frame 56. When the shutter 46 is pressed to the back in the apparatus depth direction in the state where the control lever 48 has been operated for the detachment preparation, the side of the shutter 46 opposite to the catching portion 47 comes into contact with the stopper portion 58, whereby the movement of the shutter 46 to the back in the apparatus depth direction is restricted. In this manner, operating the control lever 48 for the detachment preparation restricts the movement of the shutter 46 from the position in which the shutter 46 closes the outlet port 44.

As illustrated in FIG. 8, when the control lever 48 is positioned in the first rotation position, the second end portion 48B is located on the attachment/detachment path along which the photoconductor unit 30 passes when attached to or detached from the housing 11. When the control lever 48 is positioned in the second rotation position, the second end portion 48B is located aside from the attachment/detachment path of the photoconductor unit 30.

As illustrated in FIG. 8, a handle 60, which is an example of a handle used for attaching or detaching the photoconductor unit 30 to or from the housing 11, is disposed on the front surface of the housing 31 of the photoconductor unit 30 in the apparatus depth direction. This handle 60 is disposed above the shutter 46. In other words, the shutter 46 is disposed below the handle 60.

Subsequently, operational effects of the developer discharge structure 40 according to the exemplary embodiment is described.

In the developer discharge structure 40, when the recovery container 34 is moved to the detached position (removed), the shutter 46 closes the outlet port 44. Here, in the case where the housing 31 of a photoconductor unit 30 is to be detached from the housing 11, an operation for a detachment preparation is performed in which the control lever 48 is rotated clockwise from the first rotation position to the second rotation position. When the control lever 48 is operated for the detachment preparation, the developing device 18 is moved with respect to the photoconductor 12. At this time, the stopper portion 58 of the support frame 56 is located on the movement path of the shutter 46, so that the movement of the shutter 46 in such a direction as to open the outlet port 44 is restricted. Specifically, in the developer discharge structure 40, operating the control lever 48 for the detachment preparation brings the shutter 46 into the state of closing the outlet port 44. Thus, in contract to the configuration in which, for example, the shutter 46 remains unrestricted even after the control lever 48 is operated for the detachment preparation, unnecessary opening of the outlet port 44 due to causes such as an erroneous operation on the shutter 46 involved with detachment of the photoconductor unit 30 (including the photoconductor 12) from the housing 11 is prevented.

When the photoconductor unit 30 is detached while the movement of the shutter 46 in such a direction as to open the outlet port 44 is restricted, unnecessary opening of the outlet port 44 due to causes such as an erroneous operation on the shutter 46 involved with the detachment is prevented. Moreover, since the shutter 46 is disposed below the handle 60 of the photoconductor unit 30, an erroneous operation on the shutter 46 is more reliably prevented when the photoconductor unit 30 is detached while the handle 60 is gripped than in the case, for example, where the shutter 46 is disposed above the handle 60.

In the developer discharge structure 40, when the control lever 48 is operated for the detachment preparation, the second end portion 48B of the control lever 48 is located aside from the attachment/detachment path along which the photoconductor unit 30 passes when attached to or detached from the housing 11. Thus, in contrast to the configuration, for example, in which the control lever 48 is located aside from the attachment/detachment path along which the photoconductor unit 30 passes when attached to or detached from the housing 11 in either case where the control lever 48 is positioned in the first rotation position or the second rotation position, unnecessary opening of the outlet port 44 due to causes such as an erroneous operation on the shutter 46 involved with the detachment of the photoconductor unit 30 from the housing 11 is prevented.

In addition, the image forming apparatus 10 according to the exemplary embodiment includes the developer discharge structure 40. Thus, when the photoconductor unit 30 is detached, unnecessary opening of the outlet port 44 due to causes such as an erroneous operation on the shutter 46 involved with the detachment of the photoconductor unit 30 from the housing 11 is prevented in contrast to the configuration, for example, that does not include the developer discharge structure 40.

Figure 14:
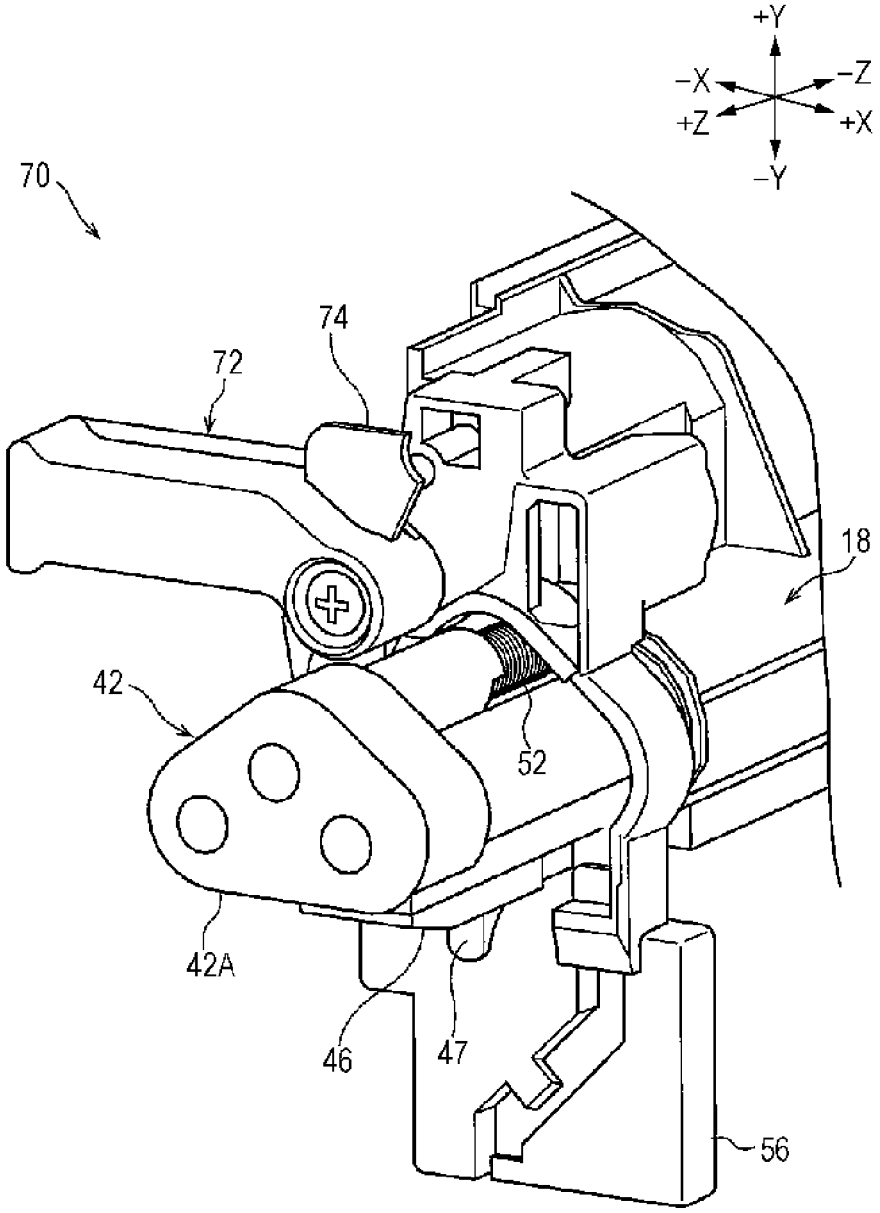
FIG. 14 is an enlarged perspective view of a characteristic portion of a developer discharge structure according to a modified example, obtained by modifying the developer discharge structure according to an exemplary embodiment of the invention, and illustrates a recovery container in the state of being detached from the image forming apparatus and an operating member in the state of being positioned in a first rotation position.
Figure 15:
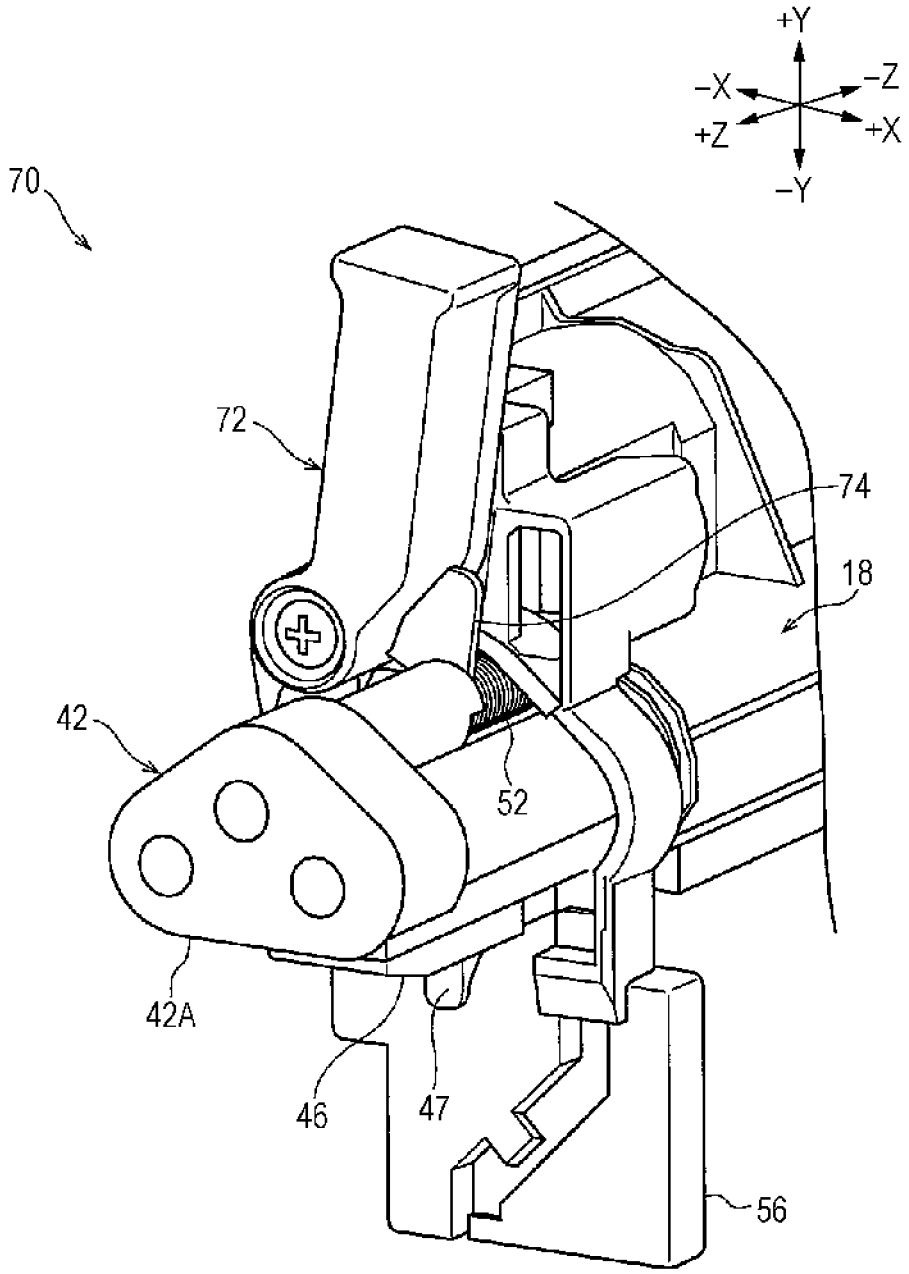
FIG. 15 corresponds to an enlarged perspective view of the characteristic portion of the developer discharge structure in FIG. 14 and illustrates the operating member in the state of being positioned in a second rotation position.

In the above-described exemplary embodiment, the developing device 18 is tilted with respect to the support frame 56 by operating the control lever 48 for the detachment preparation, so that the stopper portion 58 of the support frame 56 is located on the movement path of the shutter 46 and the movement of the shutter 46 to the back in the apparatus depth direction is restricted. However, this is not the only configuration of the present invention. For example, as in the case of a developer discharge structure 70 illustrated in FIG. 14 and FIG. 15, a control lever 72 may include a stopper portion 74, the stopper portion 74 may be engaged with the shutter 46 as a result of operating the control lever 72 for the detachment preparation, so that the movement of the shutter 46 to the back in the apparatus depth direction may be restricted. This configuration does not involve the need for tilting the developing device 18 with respect to the support frame 56 as a result of operating the control lever 72 for the detachment preparation, whereby this configuration allows the retracting mechanism to be a simple mechanism.

The developer discharge structure according to the above-described exemplary embodiment of the invention is used as a system, in the developing device 18, for circulating the developer G. The present invention, however, is not limited to this configuration. For example, an exemplary embodiment may be used as a system, in a cleaning device 26 or the transfer device 22, for discharging the developer G.

Although specific exemplary embodiments of the invention have been described in detail, the invention is not limited to the above-described exemplary embodiment. It is obvious to the persons having ordinary skill in the art that various other exemplary embodiments are possible within the scope of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. The developer discharge structure, comprising:

a tube-shaped container portion configured to be disposed in an apparatus body and configured to hold developer, the container portion having an outlet port at a first axial end portion of the container portion, the outlet port configured to allow the developer to discharge to a recovery container;

an opening-closing member disposed in the container portion, the opening-closing member being configured to open the outlet port when the recovery container is positioned in an attached position in which the recovery container is attached to the apparatus body, the opening-closing member being configured to close the outlet port when the recovery container is positioned in a detached position in which the recovery container is detached from the apparatus body; and an operating member disposed in the apparatus body, the operating member being configured to perform an operation for a detachment preparation, in which an adjacent member disposed adjacent to the container portion is prepared for detachment from the apparatus body, to restrict movement of the opening-closing member from a position in which the opening-closing member closes the outlet port, wherein the adjacent member comprises an image carrier on which an electrostatic latent image may be formed, wherein the operating member is disposed on the apparatus body so as to be rotatable, the operating member, when positioned in a first rotation position, moves the container portion so as to be closer to the image carrier, and the operating member, when positioned in a second rotation position, moves the container portion away from the image carrier and restricts movement of the opening-closing member from a position in which the opening-closing member closes the outlet port.

2. The developer discharge structure according to claim 1, wherein when the operating member is positioned in the first rotation position, the operating member is located on an attachment/detachment path along which the image carrier passes when attached to or detached from the apparatus body, whereas when the operating member is positioned in the second rotation position, the operating member is located aside from the attachment/detachment path of the image carrier.

3. The developer discharge structure according to claim 1, wherein the image carrier includes a handle configured to be operated for attachment or detachment, and wherein the opening-closing member is disposed below the handle.

4. The developer discharge structure according to claim 2, wherein the image carrier includes a handle configured to be operated for attachment or detachment, and wherein the opening-closing member is disposed below the handle.

5. An image forming apparatus, comprising:

an image carrier configured to be disposed in an apparatus body and configured to allow an electrostatic latent image to be formed thereon;

a developing device configured to be disposed in the apparatus body and configured to develop the electrostatic latent image formed on the image carrier with developer; and the developer discharge structure according to claim 1 configured to discharge the developer to the recovery container from the container portion disposed in the developing device.

* * * * *